US007294798B2

(12) United States Patent
Binka

(10) Patent No.: US 7,294,798 B2
(45) Date of Patent: Nov. 13, 2007

(54) MECHANICAL LOCKING DEVICE FOR CONTACTORS, AND AUXILIARY TOOL THEREFOR

(75) Inventor: Konrad Binka, Bonn (DE)

(73) Assignee: Moeller GmbH, Bonn (DE)

( * ) Notice: Subject to any disclaimer, the term of this patent is extended or adjusted under 35 U.S.C. 154(b) by 323 days.

(21) Appl. No.: 10/540,322

(22) PCT Filed: Jun. 9, 2004

(86) PCT No.: PCT/EP2004/006217

§ 371 (c)(1),
(2), (4) Date: Jun. 21, 2005

(87) PCT Pub. No.: WO2004/114344

PCT Pub. Date: Dec. 29, 2004

(65) Prior Publication Data

US 2006/0054477 A1 Mar. 16, 2006

(30) Foreign Application Priority Data

Jun. 25, 2003 (DE) ..... 103 28 499

(51) Int. Cl.
*H01H 9/26* (2006.01)

(52) U.S. Cl. ..... 200/50.32; 200/50.33

(58) Field of Classification Search .. 200/50.32–50.37, 200/50.4; 81/488; 254/1; 414/1, 2; 29/700, 29/724, 729, 756, 244, 270
See application file for complete search history.

(56) References Cited

U.S. PATENT DOCUMENTS 3,240,889 A 3/1966 Lawrence et al. ..... 200/50
3,536,868 A * 10/1970 Lawrence et al. ..... 200/50.33
3,592,985 A * 7/1971 Arneberg et al. ..... 200/50.33
4,409,575 A * 10/1983 Hisadome ..... 200/50.33
5,103,199 A 4/1992 Ootsuka ..... 335/133
6,002,579 A * 12/1999 Drexler et al. ..... 200/50.33
6,005,202 A * 12/1999 Drexler et al. ..... 200/50.33

(Continued)

FOREIGN PATENT DOCUMENTS

DE 19 09 676 U 2/1965

(Continued)

OTHER PUBLICATIONS

International Search Report for PCT/EP2004/006217 (4 pages).

*Primary Examiner*—Michael A Friedhofer
(74) *Attorney, Agent, or Firm*—Darby & Darby P.C.

(57) ABSTRACT

A mechanical locking device for mechanically connected contactors includes a first and a second actuating member and a locking element. The actuating members are operatively connected respectively to an electromagnetic operating mechanism and a movable contact of a respective contactor. The first actuating member has a first curved recess adjacent the first connecting sidewall. The second actuating member has a second curved recess adjacent the second connecting sidewall. The locking element includes a rolling element received in a respective opening in each of the first and second connecting sidewalls. The first actuating member urges the locking element into the second recess when the first contactor is in a switched-on condition and the second actuating member urges the locking element into the first recess when the second contactor is in a switched-on condition.

8 Claims, 2 Drawing Sheets

U.S. PATENT DOCUMENTS

| | | | | |
|---|---|---|---|---|
| 6,140,896 | A * | 10/2000 | Heckenkamp | 200/50.32 |
| 6,541,719 | B1 * | 4/2003 | Powell | 200/50.32 |
| 6,566,615 | B2 * | 5/2003 | Takeda | 200/50.33 |
| 6,861,596 | B2 * | 3/2005 | Schnackenberg | 200/50.32 |
| 7,005,590 | B1 * | 2/2006 | Willis | 200/50.32 |

FOREIGN PATENT DOCUMENTS

| | | |
|---|---|---|
| DE | 40 30 333 | 4/1991 |
| DE | 195 48 480 | 5/1997 |

* cited by examiner

MECHANICAL LOCKING DEVICE FOR CONTACTORS, AND AUXILIARY TOOL THEREFOR

The present invention relates to a locking device for preventing two electromagnetically operable contactors forming a switch block from being simultaneously switched on, and to an auxiliary tool for making such a locking device, as defined in the preambles of the independent claims.

BACKGROUND

German Patent Application DE 40 30 333 A1 describes a locking device for laterally joined contactors whose actuating members for the movable contacts are electromagnetically moved in a direction substantially perpendicular to the connecting sidewalls. The two contactors are received in a common lower housing part. The actuating members, of the two contactors have facing projections, which stand back from the connecting sidewalls and between which is supported a locking pin that is movable in a direction perpendicular to the connecting sidewalls, which are provided with openings at this location. When switching on one of the two contactors, the projection thereof moves the locking pin toward the other contactor. When attempting to switch on the other contactor, the projection thereof strikes the locking pin. The holding force of the electromagnetic operating mechanism of the already switched-on contactor is greater than the pickup force of the electromagnetic operating mechanism of the other contactor, which prevents the actuating member of the other contactor from moving to the ON position. It is a disadvantage of this locking device that, on the one hand, the actuating members are required to move in a direction perpendicular to the connecting sidewalls, and that the locking effect is no longer guaranteed when the electromagnetic operating mechanisms are operated with a holding power that is markedly reduced compared to the pickup power, which is what is generally being aimed at.

German Patent DE 195 48 480 C1 describes a locking device of this type which avoids the aforementioned disadvantages. The moving direction of the actuating members is perpendicular to the front face of the laterally joined contactors. A support element is inserted in opposite first slots in the connecting sidewalls, the support element supporting a locking element in the form of an anchor which is able to pivot in a direction perpendicular to the connecting sidewalls. The connecting sidewalls have opposite second slots for receiving the anchor. When energizing the electromagnetic operating mechanisms of both contactors simultaneously, the anchor engages recesses of both actuating members and prevents both contactors from being switched on. The recesses are each bounded by a front inner surface, a central inner surface, and a rear inner surface, which extend parallel or perpendicular or at an angle to the front faces, respectively. When energizing the electromagnetic operating mechanism of one contactor alone, the anchor is moved out of the recess of the actuating member of this contactor and pushed into the recess of the actuating member of the other contactor, thereby effectively locking the same from being switched on. The two contactors are connected by connecting elements whose outer legs engage like brackets around ribs extending from the connecting sidewalls and whose central leg engages in a positively locking manner in a recess formed in the connecting sidewalls. In this locking device, two complicated parts are needed for the support element and the anchor, which involves high tooling costs. The existing locking stroke of the locked contactor requires exact matching of the geometries of the first slots, the support elements, the anchors, the recesses, and of the geometry, support and kinematics of the actuating members.

U.S. Pat. No. 4,409,575 A shows a mechanical interlock mechanism for mechanically connected contactors, including a locking element in the form of a rolling element, such as a cylindrical roller or a hollow cylindrical roller, which is supported in a connecting frame between the spaced apart contactors and is actuated by the contact frame of the respective contactor that is energized. The disadvantage here is the need for a connecting frame and the associated, relatively large spatial distance between the opposite sidewalls of the two contactors.

SUMMARY OF INVENTION

An object of the present invention is to facilitate the mutual locking of two contactors whose actuating members move in a direction parallel to the connecting sidewalls.

The present invention provides a mechanical locking device for mechanically connected contactors includes a first and a second actuating member and a locking element. The actuating member is operatively connected to a first electromagnetic operating mechanism and a first movable contact of the first contactor. The second actuating member is operatively connected to a second electromagnetic operating mechanism and a second movable contact of the second contactor. The first actuating member has a first curved recess adjacent the first connecting sidewall. The second actuating member has a second curved recess adjacent the second connecting sidewall. The locking element includes a rolling element received in a respective opening in each of the first and second connecting sidewalls. The first actuating member urges the locking element into the second recess when the first contactor is in a switched-on condition and the second actuating member urges the locking element into the first recess when the second contactor is in a switched-on condition.

The locking device of to the present invention simply requires only one additional part in the form of a rolling element, which cooperates with curved recesses of the actuating members as a connecting element. This type of locking results in a very small idle stroke for the contactor to be locked, which helps to increase reliability and allows the design engineer to calculate the play stroke in a simple manner. The electromagnetic operating mechanisms may be operated with a markedly reduced holding power.

The locking element may be implemented in an inexpensive manner using a purchased commercial part in the form of a ball, a cylindrical roller, a barrel-shaped roller, or a disk.

The present invention also provides an auxiliary tool. The auxiliary tool of the present invention facilitates the assembly of the locking device according to the present invention. A receiving space formed by the fork slot elastically holds the locking element at its opposite surface portions which are perpendicular to the connecting sidewalls and to the moving direction of the actuating members. Prior to fitting the locking device to a mounting rail or to another suitable mounting base, the two contactors must be brought together such that their connecting sidewalls are spaced apart by a distance that still allows the locking element held between the fork prongs to be moved by the auxiliary tool into the region of the openings in the connecting sidewalls. After moving the contactors closer together, the locking element extending beyond the flat sides of the auxiliary tool is trapped within the facing openings, allowing the auxiliary tool to be detached from the locking element and removed from the space between the connecting sidewalls. The locking device is completed by a final movement together of the contactors.

The reliability with which the locking element is held is increased by adapting the fork slot in the flat sides to the shape of the locking element to be held. Designing both ends of the auxiliary tool to hold a locking element serves the purpose of holding either a replacement locking element or, when suitably adapted, a differently shaped locking element at the second end.

BRIEF DESCRIPTION OF THE DRAWING

Further details and advantages of the present invention will become apparent from the exemplary embodiments described below with reference to the Figures, in which.

DETAILED DESCRIPTION

Figure 1:
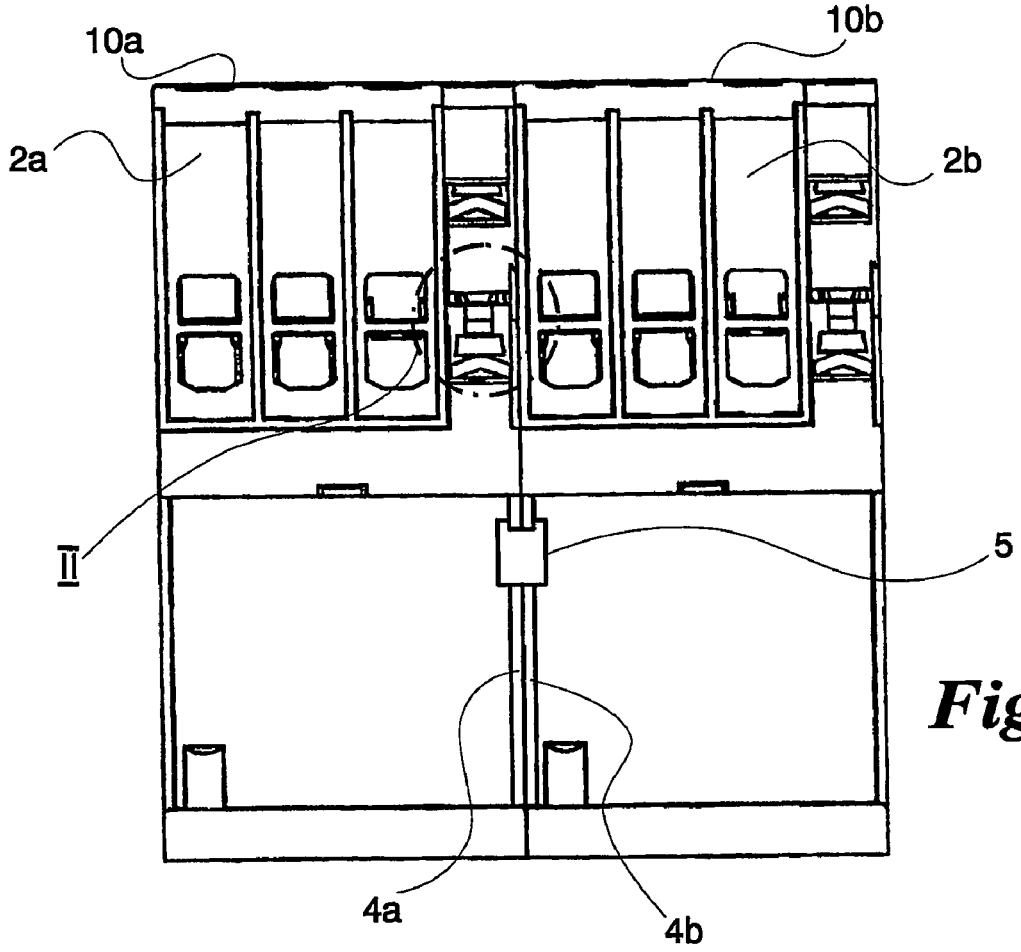
FIG. 1 shows the arrangement of two laterally joined lockable contactors.

In FIG. 1, two mutually lockable contactors 2*a* and 2*b* are shown side-by-side. Contactors 2*a*, 2*b* are attached to a mounting base (not shown), such as a standard mounting rail. The right connecting sidewall 4*a* of contactor 2*a*, shown on the left, immediately adjoins the left connecting sidewall 4*b* of contactor 2*b* shown on the right. The two contactors 2*a*, 2*b* are joined together at opposite sides in a customary fashion and such that they are flush with each other, using bracket-like connecting elements 5, as is described, for example, in German Patent DE 195 48 480 C1. Thus, contactors 2*a*, 2*b* are no longer able to move away from one another.

Locking device 1 of contactors 2*a*, 2*b* will now be described in more detail with reference to FIG. 2, which shows detail II from FIG. 1. Connecting sidewalls 4*a*, 4*b* have two facing openings 6*a* and 6*b*, respectively. A portion of an actuating member 8*a* or 8*b* is located in the immediate vicinity of connecting sidewalls 4*a*, 4*b*, respectively. Actuating members 8*a*, 8*b* are operatively connected or coupled, on the one hand, to the electromagnetic operating mechanisms, and, on the other hand, to the movable contacts of contactors 2*a* and 2*b*, respectively. The moving direction of actuating members 8*a*, 8*b* is parallel to connecting sidewalls 4*a*, 4*b* and perpendicular to front faces 10*a*, 10*b* of contactors 2*a* and 2*b*. Actuating members 8*a*, 8*b* are provided with spherical cap-shaped recesses 12*a* or 12*b* in the vicinity of openings 6*a*, 6*b*. Recesses 12*a*, 12*b* are open to neighboring connecting sidewalls 4*a* and 4*b*, respectively. A locking element 14 in the form of a spherical rolling element made of metal, ceramic, plastic or glass-containing material rests within openings 6*a*, 6*b*. To the left and to the right, locking element 14 is held by adjacent portions of actuating members 8*a*, 8*b* and, for the rest, by the lateral boundaries of openings 6*a*, 6*b*.

Figure 2:
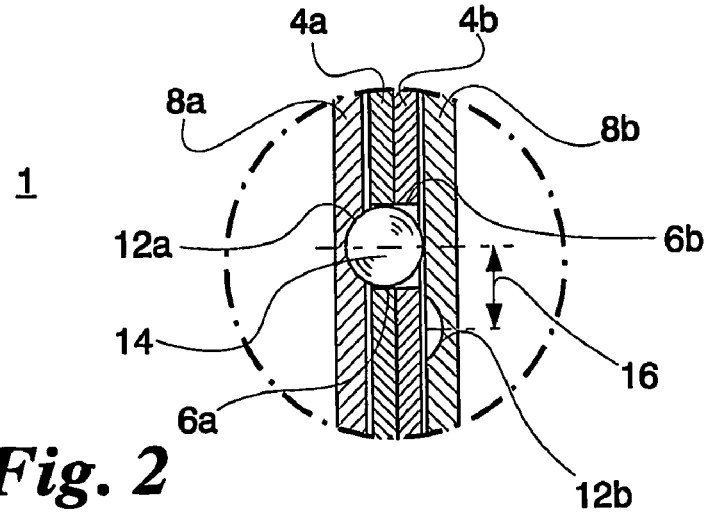
FIG. 2 depicts the inventive locking device as detail II from FIG. 1.

When both contactors 2*a* and 2*b* are in the OFF state, the two actuating members 8*a* and 8*b* assume the upper position, which is depicted in FIG. 2 for actuating member 8*a* shown on the left. In this situation, locking element 14 rests loosely between the two recesses 12*a* and 12*b*, which, in this instance, directly face each other through openings 6*a* and 6*b*. When, starting from this situation, one of the two contactors 2*a* or 2*b* is switched on, its actuating member 8*a* or 8*b* may move unhindered from top to bottom, with respect to the view of FIG. 2. In the case illustrated in FIG. 2, contactor 2*b* located on the right has been switched on. As the associated actuating member 8*b* moves to the lower position by actuation stroke 16, locking element 14 is removed from the region of recess 12*b* and displaced through openings 6*b* and 6*a* to the left by the portion of this actuating member 8*b* that is not set back, and further into recess 12*a* of actuating member 8*a* of contactor 2*a*, which is shown on the left. Contactor 2*a* located on the left is thus locked from being switched on, because when attempting to switch on left contactor 2*a* as well, the blocked movement to the right of locking device 14 makes it impossible for actuating member 8*a* of left contactor 2*a* to move with its recess 12*a* out of engagement with locking device 14.

When the electromagnetic operating mechanisms of both contactors 2*a* and 2*b* are energized simultaneously, both actuating members 8*a* and 8*b* are prevented from moving downward, according to the view of FIG. 2, because the two spherical cap-shaped recesses 12*a* and 12*b* cannot simultaneously move out of engagement with locking device 14. When attempting to switch on contactors 2*a* and 2*b* simultaneously, they are held in the OFF state in conformity with regulations. Therefore, no race can occur between contactors 2*a*, 2*b*.

Figure 3B:
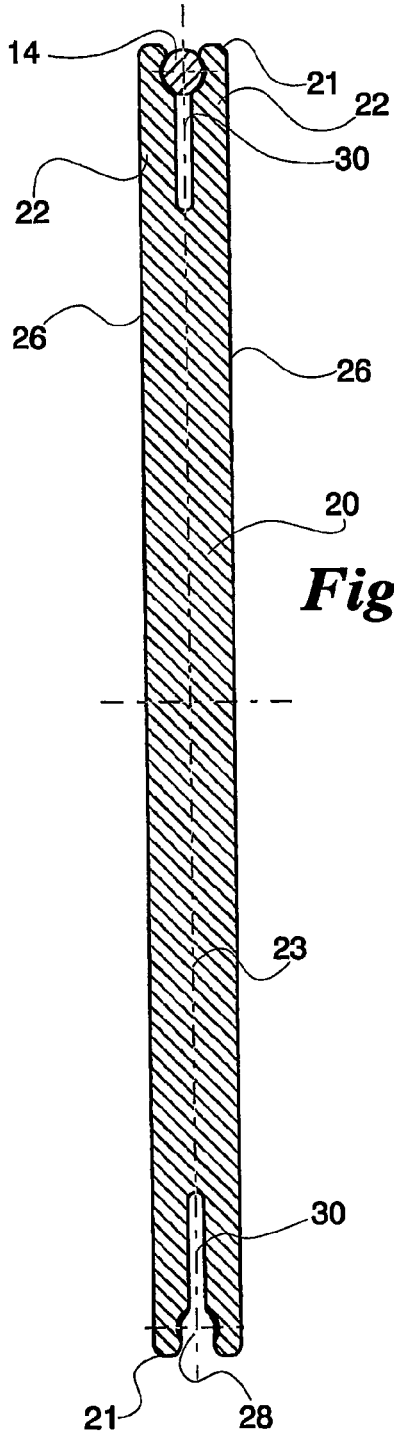
FIG. 3 shows an inventive auxiliary tool for making the locking device of the present invention in a perspective view (FIG. 3*a*) and in a slightly enlarged sectional view through the center plane (FIG. 3*b*).
Figure 3A:
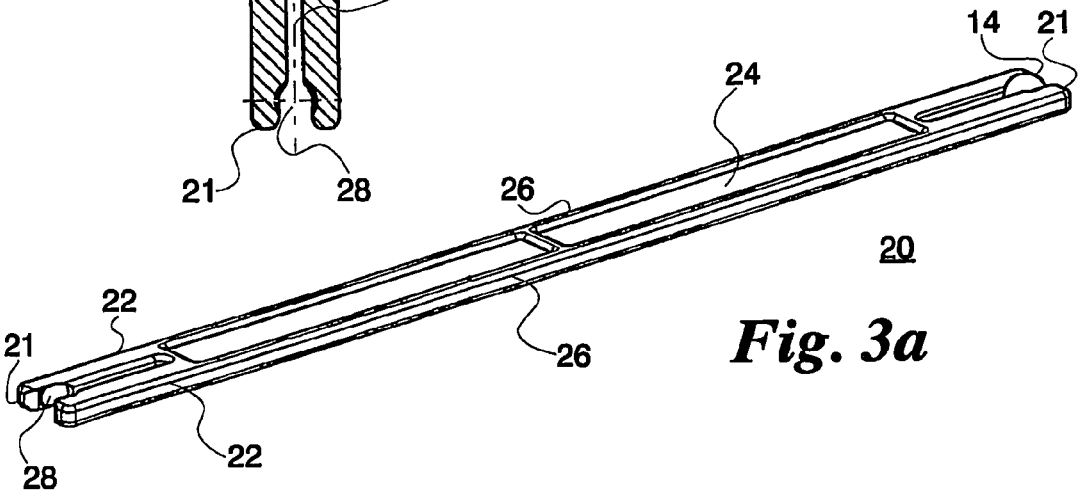

To facilitate insertion of locking element 14 between openings 6*a*, 6*b*, the fitter can use auxiliary tool 20 shown in FIG. 3. Elongated auxiliary tool 20 is made of elastic material, preferably of plastic, and is designed at both ends 21 to receive the spherical locking element 14. For this purpose, ends 21 are split symmetrically into fork prongs 22. Receiving spaces 28 formed by elastic fork prongs 22 at both ends 21 can each hold one locking element 14 in a clamping fashion. For improved retention of locking elements 14, fork slots 30 are shaped in the form of spherical caps toward narrow sides 26 in the area of receiving spaces 28 to adapt them to the spherical shape of locking element 14. In the unloaded condition, it has proven advantageous for the fork slot opening width to be ¾ of the ball diameter of locking element 14, and for the facing inner surfaces of the spherical indentations in receiving spaces 28 to have a maximum distance of slightly less than the ball diameter. For example, for a ball diameter of 4 mm, the opening width is 3 mm and the maximum distance between the inner surfaces of the spherical indentations is 3.8 mm.

Locking element 14 is received in auxiliary tool 20 in such a way that part of its surface extends beyond flat sides 24. To insert locking element 14 into openings 6*a*, 6*b*, contactors 2*a*, 2*b* are initially brought to a distance at which locking element 14 still fits between the connecting sidewalls 4*a*, 4*b*. When flat sides 24 of auxiliary tool 20 face connecting sidewalls 4*a*, 4*b*, the auxiliary tool provided with locking element 14 may reach between contactors 2*a*, 2*b* and bring locking element 14 into the region of openings 6*a*, 6*b*. When contactors 2*a*, 2*b* are now moved closer together, locking element 14 is held by openings 6*a*, 6*b* and moved out of engagement with fork prongs 22 when auxiliary tool 20 is being withdrawn. Then, contactors 2*a*, 2*b* may finally be moved together such that they are flush with each other, and be joined by connecting elements 5, after which locking device 1 is complete.

The present invention is not limited to the specific embodiments described above but includes also all equally acting embodiments along the lines of the present invention. Thus, the locking device 1 may also be implemented using a locking element in the form of, for example, a cylindrical roller, a barrel-shaped roller, a circular disk, or an elongated disk. Recesses 12*a*, 12*b* on actuating members 8*a*, 8*b* and the shape of fork slots 30 in the flat sides of auxiliary tool 20 have to be adapted to the shape of the locking element accordingly.

What is claimed is:

1. A mechanical locking device for mechanically connected contactors, the device comprising a first and a second actuating member configured to move in a direction parallel to a first connecting sidewall of a first contactor and a second connecting sidewall of a second contactor, the first actuating member being operatively connected to a first electromagnetic operating mechanism and a first movable contact of the first contactor, the second actuating member being operatively connected to a second electromagnetic operating mechanism and a second movable contact of the second contactor, the first actuating member defining a first curved recess disposed adjacent the first connecting sidewall, the second actuating member defining a second curved recess disposed adjacent the second connecting sidewall; and a locking element including a rolling element configured to be received in a respective opening in each of the first and second connecting sidewalls;

wherein the first actuating member is configured to urge the locking element into the second recess when the first contactor is in a switched-on condition and the second actuating member is configured to urge the locking element into the first recess when the second contactor is in a switched-on condition.

2. The locking device as recited in claim 1 wherein the first and second recesses each include a shape of a spherical cap and the rolling element includes a form of a ball.

3. The locking device as recited in claim 1 wherein the first and second recesses each include a shape of a cylindrical segment and the rolling element includes a form of a cylindrical roller.

4. The locking device as recited in claim 1 wherein the first and second recesses each include a shape of a barrel segment and the rolling element includes a form of a barrel-shaped roller.

5. The locking device as recited in claim 1 wherein the first and second recesses each include a form of a disk segment and the rolling element includes a form of a disk.

6. An auxiliary tool for holding and inserting a locking element into respective facing first and second openings in respective first and second connecting sidewalls of respective first and second contactors to be mechanically locked, a first and a second actuating member being configured to move in a direction parallel to the first and second connecting sidewalls, the first actuating member being operatively connected to a first electromagnetic operating mechanism and a first movable contact of the first contactor, the second actuating member being operatively connected to a second electromagnetic operating mechanism and a second movable contact of the second contactor, the first actuating member defining a first curved recess disposed adjacent the first connecting sidewall, the second actuating member defining a second curved recess disposed adjacent the second connecting sidewall, the first actuating member being configured to urge the locking element into the second recess when the first contactor is in a switched-on condition and the second actuating member being configured to urge the locking element into the first recess when the second contactor is in a switched-on condition, the locking element including a rolling element configured to be received in the first and second openings, the auxiliary tool comprising:

an elongated flat portion including a side;

an elastic fork portion extending from an end of the elongated flat portion, the elastic fork defining a fork slot having a receiving space configured to elastically hold the rolling element so that a first portion of the held rolling element protrudes above the side of the elongated flat portion, the first portion facing the first or second connecting wall when the rolling element is inserted in the facing openings of the first and second openings in the respective first and second connecting sidewalls.

7. The auxiliary tool as recited in claim 6 further comprising a holding portion extending from a second end of the elongated flat portion, the holding portion being configured to receive the rolling element.

8. The auxiliary tool as recited in claim 7 wherein the holding portion includes a second elastic fork portion, the second fork defining a second fork slot having a second receiving space configured to elastically hold the rolling element so that the first portion of the held rolling element protrudes above the side of the elongated flat portion, the first portion facing the first or second connecting wall when the rolling element is inserted in the facing openings of the first and second openings in the respective first and second connecting sidewalls.

* * * * *